US007539444B2

(12) United States Patent
Nukada et al.

(10) Patent No.: US 7,539,444 B2
(45) Date of Patent: May 26, 2009

(54) ELECTROPHOTOGRAPHIC APPARATUS USING A DEVELOPING SOLUTION CONTAINING A LIQUID CARRIER FORMED BY DISPERSING TONER PARTICLES IN A SOLVENT

(75) Inventors: Hideki Nukada, Yokohama (JP); Yuko Nomura, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/115,965

(22) Filed: May 6, 2008

(65) Prior Publication Data

US 2008/0219708 A1 Sep. 11, 2008

Related U.S. Application Data

(62) Division of application No. 11/387,975, filed on Mar. 24, 2006.

(30) Foreign Application Priority Data

Jun. 13, 2005 (JP) ..... 2005-172616

(51) Int. Cl.
*G03G 15/00* (2006.01)

(52) U.S. Cl. ..... 399/249

(58) Field of Classification Search ..... 399/162, 399/164, 165, 239, 249
See application file for complete search history.

(56) References Cited

U.S. PATENT DOCUMENTS 3,795,011 A * 2/1974 Ohta ..... 347/112
6,305,860 B1 10/2001 Park
7,058,341 B2 6/2006 Kellie

FOREIGN PATENT DOCUMENTS

JP 2001-228716 8/2001

* cited by examiner

*Primary Examiner*—David M Gray
*Assistant Examiner*—Ruth N Labombard
(74) *Attorney, Agent, or Firm*—Oblon, Spivak, McClelland, Maier & Neustadt, P.C.

(57) ABSTRACT

According to an embodiment, an image shift can be decreased by a photoconductor belt which has a photosensitive layer formed on the surface of a cylindrically formed belt, a pair of rollers which is placed to apply tension to a photoconductor belt, and rotates the photoconductor belt in a specified direction, a charger which is placed opposite to the surface of the photoconductor belt placed between the pair of rollers, and charges the photosensitive layer, a light source which forms a latent image on the charged photosensitive layer, a developing unit which supplies a developing solution to the photosensitive layer having a latent image, develop the latent image, and forms a toner image, and an absorbing roller which is placed on the backside of the photoconductor belt placed between a pair of rollers, and absorbs the photoconductor belt.

5 Claims, 3 Drawing Sheets

ELECTROPHOTOGRAPHIC APPARATUS USING A DEVELOPING SOLUTION CONTAINING A LIQUID CARRIER FORMED BY DISPERSING TONER PARTICLES IN A SOLVENT

CROSS-REFERENCE TO RELATED APPLICATIONS

This application is a divisional application of Ser. No. 11/387,975, filed Mar. 24, 2006, which is based upon and claims benefit of priority from the prior Japanese Patent Applications No. 2005-172616, filed on Jun. 13, 2005; the entire contents of both of which are incorporated herein by reference.

BACKGROUND OF THE INVENTION

1. Field of the Invention

The present invention relates to an electrophotographic apparatus, which uses a developing solution containing a liquid carrier formed by dispersing toner particles in a solvent.

2. Description of the Related Art

An electrophotographic apparatus using a liquid developing agent or a developing solution containing toner dispersed in a liquid carrier has been recently reevaluated in light of features unrealized by a dry-type electrophotographic recorder, such as high image quality equivalent to offset printing realized by using submicron size toner particles, sufficient image density obtained by a small amount of toner particles, reduced copy cost, and fixing of toner particles to a recording paper sheet at a relatively low temperature, and saving of energy.

In an electrophotographic apparatus using a developing solution, a developing unit having a development roller is generally used. A part of a development roller is usually immersed in a developing solution holder. When a developing solution held in the developing solution holder is stuck to and carried by a rotating development roller, fresh toner liquid is supplied to the surface of a photoconductor. Jpn. Pat. Appln. KOKAI No. 2001-228716 proposes providing a microgap between a development roller and the surface of a photoconductor, and forming a meniscus of developing solution in the gap, as a method of supplying a developing solution from a development roller to the surface of a photoconductor.

However, in the method described in the above publication, it is very difficult to control the size of the gap formed on photoconductor when using a photoconductor belt (belt-like photoconductor). The photoconductor belt is easily moved in a direction along the developing unit (side) direction, and therefore the gap of the meniscus of the photoconductor belt is small in many cases.

BRIEF SUMMARY OF THE INVENTION

According to an embodiment of the invention there is provided an electrophotographic apparatus comprising:

a photoconductor belt which has a photosensitive layer on the surface, and is configured to hold an electrostatic latent image;

a belt driving mechanism which includes at least a driving roller and a tension roller, applies tension to the photoconductor belt, and circulates the photoconductor belt in a specified direction;

a charger which is placed opposite to the surface of the photoconductor belt, and gives a specified potential to the photosensitive layer;

an exposure device which forms an electrostatic image on the charged photosensitive layer;

a developing unit which supplies a developing solution to the photosensitive layer having the latent image, develops the latent image, and forms a toner image; and an absorbing roller which is provided at a specified position on the backside of the photoconductor belt, and prevents distortion of the toner image formed on the photoconductor belt by absorbing the photoconductive belt from the backside of the photoconductive belt.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Hereinafter, preferable embodiments of the present invention will be explained with reference to the accompanying drawings. The invention is not limited to the following embodiments, and can be applied in various ways.

Figure 1:
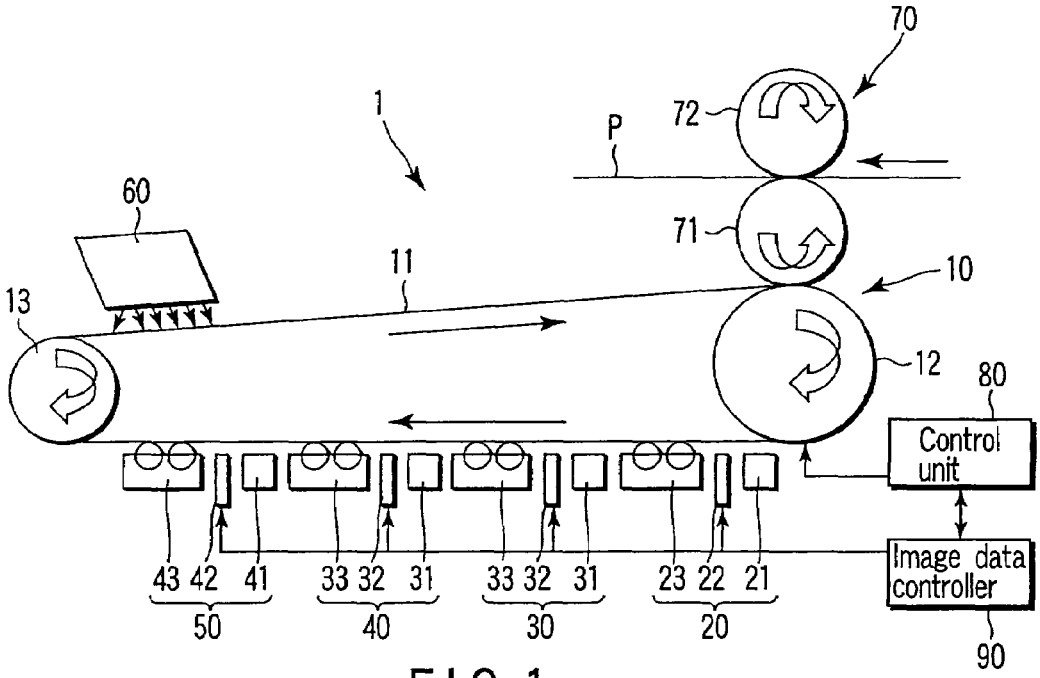
FIG. 1 is a schematic diagram of an electrophotographic apparatus according to an embodiment of the present invention.

FIG. 1 shows an embodiment of a liquid developing type electrophotographic apparatus using a liquid developing agent or a developing solution formed by dispersing toner particles in a liquid carrier.

An electrophotographic apparatus 1 includes a photoconductor unit 10, first to fourth image forming units 20, 30, 40, 50, a dryer 60, a transfer/fixing unit 70, a control unit 80 to control the operations of the component units of the electrophotographic apparatus 1 or the operation of the apparatus, and an image data controller 90 to process image data to be output as an image.

The photoconductor unit 10 includes a photoconductor belt (electrostatic latent image holder) 11 having a conductive layer that is a thin metal layer of aluminum (Al) or copper (Cu) on the surface of an endless belt made of resin such as polyethylene naphtalate (PEN) or polyethylene telephtalate (PET), and a photosensitive layer that is an organic or non-organic semiconductor laid on the conductive layer. The photoconductor belt 11 is given a specified tension (extended tightly) by a driving roller 12 and a tension roller 13, and circulated in the space between the rollers (electrostatic latent image holder circulating unit) 12 and 13 by the rotation of the driving roller 12. Namely, when the driving roller 12 is rotated in the direction of the arrow, the surface of the photoconductor belt 11 is moved in the direction from the driving roller 12 to the tension roller 13, and vice versa. The photoconductor belt 11 is given a specified tension by the rollers 12 and 13, so that the surface becomes substantially planar in the direction from the driving roller 12 to the tension roller 13.

The first to fourth image forming units 20, 30, 40 and 50 are arranged in order in the direction of circulating the photoconductor belt 11, along the belt surface moving from the driving roller 12 to the tension roller 13.

The image forming units are provided with first to fourth chargers (electric charge supply units) 21, 31, 41 and 51, first to fourth LEDS (exposure devices, i.e., image information recording unit) 22, 32, 42 and 52, and first to fourth developing units (latent image visualizing units) 23, 33, 43 and 53, respectively. The first to fourth chargers 21, 31, 41 and 51 are solid-state chargers such as a known scorotron or an ion generator, for example, and uniformly charge the surface of the photoconductor belt 11. The first to fourth exposure devices 22, 32, 42 and 52 are LED exposure devices, which involve scanning in a main scanning direction like a laser exposure device, and can perform selective exposure with respect to the photoconductor belt 11, and forms an electrostatic latent image.

The first charger 21, first LED 22 and first developing unit 23 form a first color C (cyan), for example. The second charger 31, second LED 32 and second developing unit 33 form a second color M (magenta), for example. The third charger 41, third LED 42 and third developing unit 43 form a third color Y (yellow), for example. The fourth charger 51, fourth LED 52 and fourth developing unit 53 form a fourth color BK (black), for example.

The first to fourth image forming units 20, 30, 40 and 50 are arranged substantially horizontally, so that they are opposed to the direction of the photoconductor belt 11 and regarded substantially as a straight line when viewed from the direction orthogonal to the thickness of the photoconductor belt 11 (hereinafter, referred to as a horizontal direction). This structure (arrangement) makes it easy to make the circumference of the photoconductor belt 11 long, and makes it possible to expand a span between the driving roller 12 and tension roller 13, as a result. If a span is expanded, another image forming unit for forming another color image can be easily added to the first to fourth image forming units.

The dryer 60 is provided in the side that an optional position of the photoconductor belt 11 is moved from the tension roller 13 to the driving roller 12, and used to dry and eliminate a liquid carrier in a developing solution. The dryer 60 includes an air blower, for example, and to provide an airflow of a specified velocity along the surface of the photoconductor belt 11.

The transfer/fixing unit 70 has an intermediate transfer roller 71 and a pressing roller 72, and transfers a toner image carried by the movement or circulation of an optional position of the photoconductor belt 11 (after the carrier liquid is eliminated and dried) to the intermediate transfer roller 71, and fixes the toner image to a transfer medium guided to a transfer position, for example, a paper sheet P used for image output as hard copy.

In the electrophotographic apparatus 1 shown in FIG. 1, the photoconductor belt 11 is charged to a specified potential by corona discharging or scorotron discharging from the first charger 21. On a photosensitive layer of the charged photoconductor belt, an electrostatic latent image is formed according to an image light from the first LED 22 corresponding to an image modulation signal generated by the control unit 80 and image data controller 90.

The electrostatic latent image formed on the photosensitive layer is developed (visualized) by electrostatic adhesion of toner to the electrostatic latent image when a developing solution (liquid developer) is supplied from the first developing unit 23.

It is well known that an LED (exposure device) forms an image-forming area (exposed part) and an image non-forming area (unexposed part) by selectively exposing an image on a photosensitive layer, or the uniformly charged surface of the photoconductor belt 11.

Thereafter, latent images of the colors to be developed by the corresponding developing units according to the image lights of the second to fourth colors are sequentially formed on the photosensitive layer of the photoconductor belt 11, and the latent images are developed by the corresponding developing units, whereby a full-color toner image is formed on the photoconductor belt 11.

After a developing process using a liquid developing agent (developing solution) of all colors, the toner image on the surface of the photoconductor belt 11 is dried by the dryer 60 and transferred to the peripheral surface of the intermediate transfer roller 71.

Figure 2:
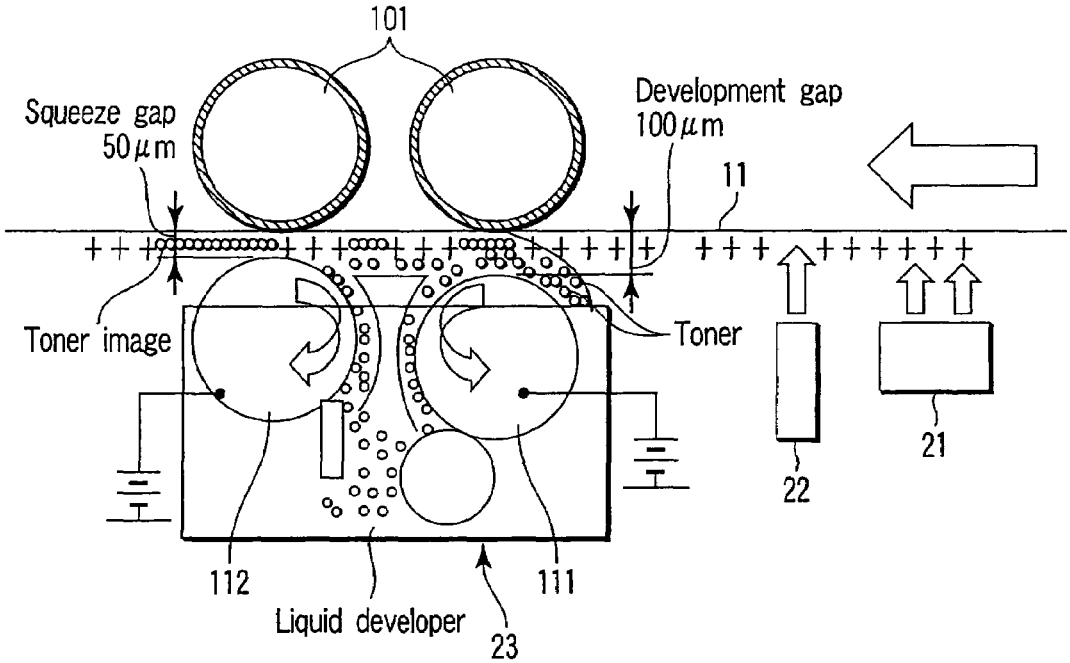
FIG. 2 is a magnified view of a part in the vicinity of a developing unit of the electrophotographic apparatus shown in FIG. 1.

FIG. 2 shows a magnified view of the first developing unit 23. The second to fourth developing units 33, 43 and 53 have the same structure.

Each developing unit 23 (33, 43, 53) has a development roller 111 and a squeeze roller 112.

The development roller 111 and squeeze roller 112 are arranged opposite to the photoconductor belt 11 through a microgap. For example, a gap between the development roller 111 and the surface of the photoconductor belt 11 is 100 μm, and a preferable range of the gap is 50-150 μm. A gap between the squeeze roller 112 and the surface of the photoconductor belt 11 is 50 μm, and a preferable range of the gap is 40-70 μm.

The development roller 111 is rotated at the position opposite to the photosensitive layer of the photoconductor belt 11 so that the rotating direction of the peripheral surface becomes the same direction as the belt circulating direction (the direction of moving an optional position of the belt), and supplies a developing solution to the gap (development gap) between the photoconductor belt 11 and development roller 111. When an appropriate potential is apphed to the surface of the development roller 111 in this state, an electric field (development electric field) is generated in the development gap. By this electric field, the toner particles contained in the developing solution is moved and made to adhere to the electrostatic latent image part formed on the photosensitive layer of the photoconductor belt 11. In other words, the toner particles moved and made to adhere to the electrostatic latent image, named electrophoresis, in the expression that the toner moves, and electrostatic absorption in the expression that the toner is absorbed by the electric field. As a result, a toner image is formed on the photosensitive layer of the photoconductor belt 11.

The squeeze roller 112 is rotated with the peripheral surface rotating direction reversed to (opposite to) the belt circulating direction (the direction of moving an optional position of the belt), and removes unnecessary developing solution from the belt surface on which the toner image is formed.

The gap (squeeze gap) between the squeeze roller 112 and the surface of the photoconductor belt 11 is very small as described above. Therefore, it should be predicated that an absorbing force (a force in the direction of absorbing the belt 11, regarding the squeeze roller 112 as an absorbing side) is generated between the squeeze roller 112 and photoconductor belt 11, depending on the viscosity of the developing solution.

Figure 3:
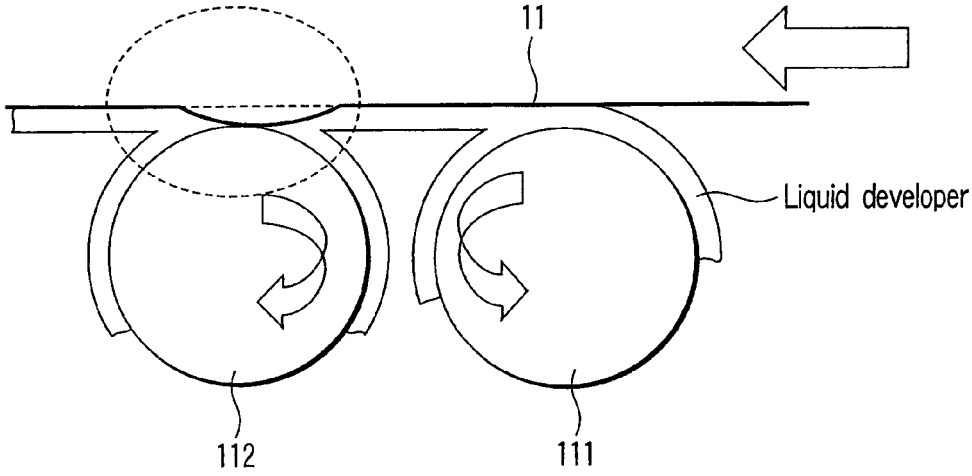
FIG. 3 is a schematic diagram explaining the slack in a photoconductor belt in the vicinity of the developing unit of the electrophotographic apparatus shown in FIG. 1.

When an absorbing force is generated between the squeeze roller 112 and belt 11, the toner image formed on the surface of the photoconductor belt 11 is removed as shown in FIG. 3, and an image error may occur as a result.

Further, as already explained in FIG. 1, when using a belt-like photoconductor made large in the part regarded as a straight line when viewed from the direction orthogonal (horizontal) to the thickness of the belt, it should be predicted that jitter (uneven speed) occurs while the belt is moving, and as a result positions of images may be slightly shifted when stacking the toner images formed by the developing units. This image position shift occurring when stacking the toner images formed by developing units is known as color shift.

Figure 4:
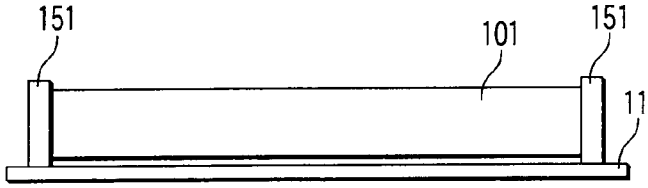
FIG. 4 is a schematic diagram of an example of an absorbing roller in the developing unit shown in FIG. 2.

FIG. 4 shows an example of an absorbing roller in the developing unit shown in FIG. 2.

The example of FIG. 4 is characterized in that an absorbing roller (image distortion correction unit) 101 is provided on the backside of the photoconductor belt 11 so as to be opposed to the developing unit 23 (33, 43 and 53).

The surface of the absorbing roller 101 is processed to absorb the photoconductor belt 11. The absorbing roller 101 prevents slacking of the photoconductor belt 11 (by the above-mentioned absorbing force generated by the squeeze roller 112).

By placing the absorbing roller 101 at the position opposite to the development roller 111 or squeeze roller 112, the absorbing gap and squeeze gap can be kept constant.

If the absorbing gap and squeeze gap are kept constant, distortion and uneven density of image are of course not generated in an electrophotographic apparatus.

As a surface treatment of the absorbing roller 101, it is sufficient that a sufficient force to absorb the photoconductor belt 11 can be obtained. Making the surface rough (matting) is one of the surface treatments. As an example of making the roller surface rough, a center average roughness, called Ra, is preferably 0.4 μm or less, and a surface roughness (maximum surface roughness) is preferably 1.6 μm or less.

A surface treatment of the absorbing roller 101 may be mirror finish. For example, a silicon rubber layer controlled in the surface roughness may be formed on the surface of the roller 101. Namely, the absorbing force of the surface of the roller 101 can be increased by increasing the thickness of a rubber layer or by using a soft rubber material. The reason why the mirror finish can increase the absorbing force is that the mirror-finished surface of the roller 101 becomes easy to deform. As a material of rubber, at least one of silicon resin, urethane resin and butyl resin is used as a main component.

Conversely, it is desirable to increase the hardness of the surface of the absorbing roller to increase the precision of the development gap and squeeze gap. This is caused by a material with high hardness providing high processing accuracy in many cases.

It is also useful to place a gap ring 151 at both ends of the absorbing roller 101 as shown in FIG. 4 in order to control (keep constant) the size of the development gap and squeeze gap. Thus, when forming the absorbing roller 101 with a rubber-based material, it is preferable to form a resin layer on the surface of the roller. The resin layer thickness is preferably 0.1-2 mm. The resin layer hardness is preferably 60-90 degrees (in JIS K6257 same as ISO 7619).

When the absorbing roller 101 contacts the backside of the photoconductor belt 11, the clearance between the absorbing roller 101 and the backside of the photoconductor belt 11 becomes substantially a vacuum (vacuum lower than atmospheric pressure), and adhesive force can be obtained.

The above absorption (adhesion) is also generated by rotation of the absorbing roller 101 when the photoconductor belt 11 is circulated. Therefore, the size of the development gap and/or squeeze gap is kept substantially constant. According to experiment, a demanded absorbing force is 30 gf per cm in the width direction (the direction orthogonal to the belt thickness) of the photoconductor belt 11 and in the axial direction of the rotation axis (the driving roller 12 or the tension roller 13).

Figure 5:
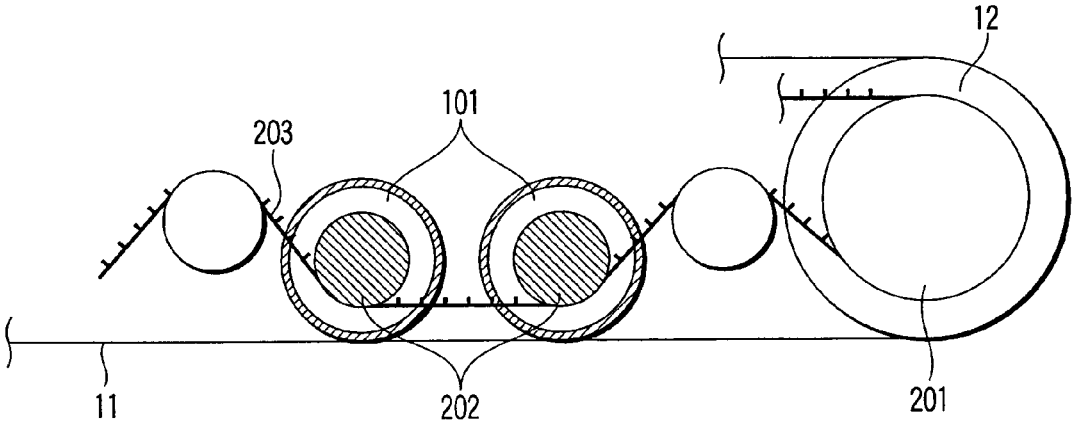
FIG. 5 is a schematic diagram of another embodiment of an absorbing roller in the developing unit shown in FIG. 2.

FIG. 5 shows an example the speed of a photoconductor belt of the electrophotographic apparatus shown in FIG. 1.

FIG. 5 shows an example in which a timing belt (synchronous belt/toothed belt) 203 is laid under the absorbing roller 101, and the moving speed of the peripheral surface (by rotation) is made identical to that of the photoconductor belt 11. As shown in FIG. 5, the driving roller 12 and absorbing roller 101 are provided integrally with timing pulleys 201 and 202, and each connected by the timing belt 203. In FIG. 5, the speed ratio of the pulleys 201 and 202 is set so that the speed of rotating the absorbing roller 101 by the timing belt 203 becomes the same as the speed of driving the photoconductor belt 11 by the driving roller 12.

In the example of FIG. 5, when the photoconductor belt 11 is circulated (driven), a local fluctuation of tension caused by the extension and/or contraction of the belt does not occur at the position where the photoconductor belt 11 is opposed to the absorbing roller 101 (the absorbing force is generated). In the configuration of FIG. 5, the magnitude (degree) of the jitter in the speed generated in the photoconductor belt 11 can be decreased.

Now, speed jitter will be explained in detail with reference to FIGS. 6A and 6B.

Figure 6A:
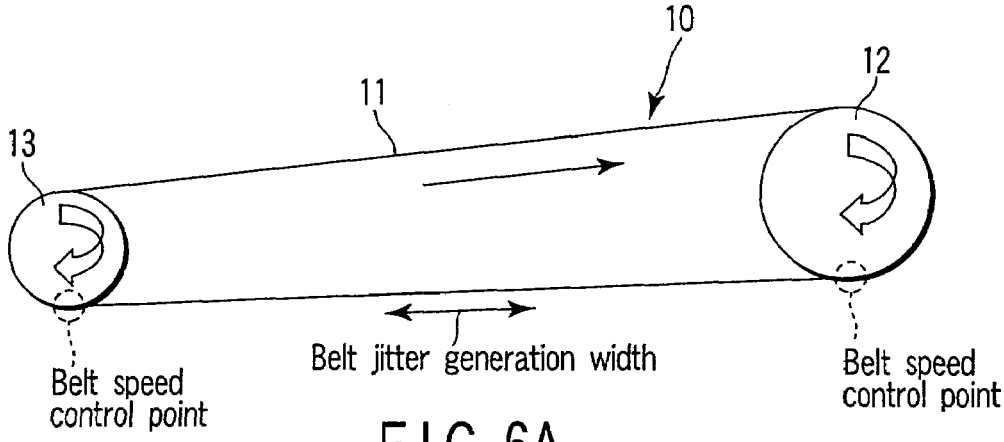
FIGS. 6A and 6B are schematic diagrams showing an embodiment to control the speed of a photoconductor belt of the electrophotographic apparatus shown in FIG. 1.

As shown in FIG. 6A, a jitter in the photoconductor belt 11 is an uneven speed generated in the moving (circulating) direction of the photoconductor belt 11. The amplitude (of the jitter) is increased proportional to the length of a free running part (a part not held by a roller) of the photoconductor belt 11.

Figure 6B:
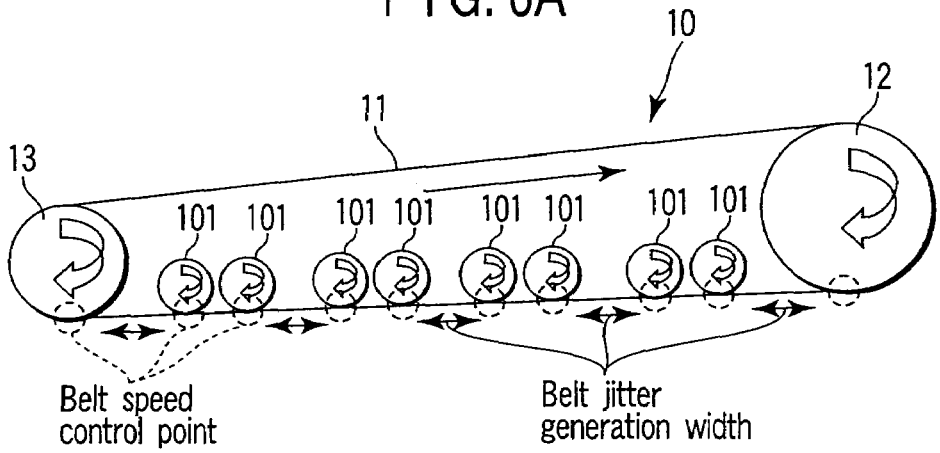

As shown in FIG. 6B, by placing the absorbing roller 101 (two or more) on the backside of the photoconductor belt 11 and causing the roller to absorb the belt 11, the free run length of the photoconductor belt 11 can be reduced. As a result, the amplitude of speed jitter can be decreased.

According to an experiment, when an absorbing roller is not provided, a developing position of each color is shifted by 100 μm maximum by jitter in a developing part. By placing the absorbing roller 101 as described above, the shift can be decreased to 20 μm maximum.

Figure 7:
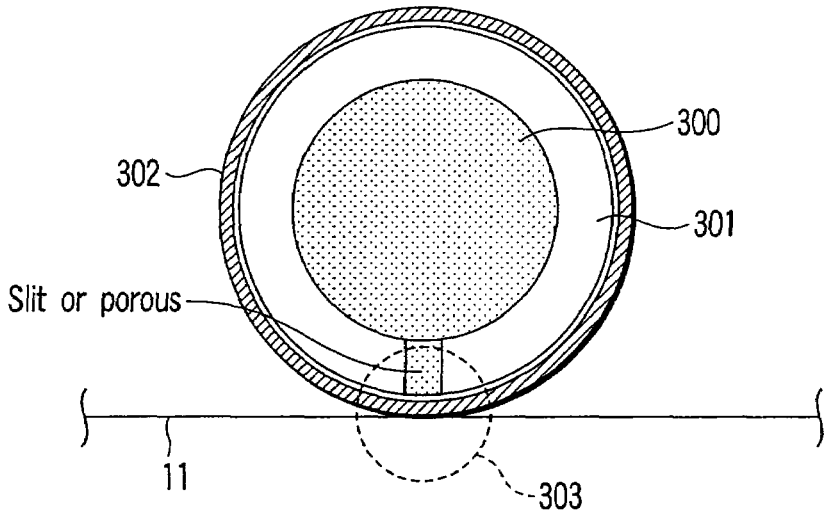
FIG. 7 is a schematic diagram of still another embodiment of an absorbing roller in the developing unit shown in FIG. 2.

FIG. 7 shows an example of generating an absorbing force by positively using a vacuum pressure in an absorbing roller.

As shown in FIG. 7, an absorbing roller has a fixed cylinder 301 including a chamber 300 opened in one end in the width direction, and a porous cylindrical roller 302 rotatable around the fixed cylinder. Though not described in detail, a negative pressure (lower than atmospheric pressure) is applied to the chamber 300 by using a vacuum pump or a compressor, and an absorbing force toward the photoconductor belt 11 can be obtained through the holes formed on the surface of the cylindrical roller 302.

The example of FIG. 7 is advantageous in ease of controlling the absorbing force by the suction force of a vacuum pump or a compressor. The magnitude of the absorbing force may be changed corresponding to the free length of a belt.

The example of FIG. 7 can control the absorbing force even if the surface of the absorbing roller is stained with dust, for example. The example is easy to replace or clean a belt, and advantageous in maintenance.

As explained alone, in a liquid developing type image forming apparatus using a developing solution according to the present invention, it is possible to prevent distortion and uneven density of an image.

The embodiment of the invention is not limited to the aforementioned embodiments. The invention may be embodied in other specific forms or modified without departing from its spirit or essential characteristics. Each embodiment may be appropriately combined as far as possible. Effects by combination will be obtained.

What is claimed is:

1. An electrophotographic image forming method comprising: holding an electrostatic latent image on a belt body having the photosensitive layer; moving the belt body in a specified direction; giving a specified potential to the photosensitive layer; forming the electrostatic latent image on the photosensitive layer; developing the electrostatic latent image with a developing solution; and giving a negative pressure to the backside of the belt body, and controlling distortion of a developed image on the photosensitive layer of the belt body, wherein a roller body having a resin layer formed by at least one of silicon resin, urethane resin and butyl resin as a main component is brought into contact with the backside of the belt body, in order to apply the negative pressure to the backside of the belt body.

2. The method according to claim 1, wherein the thickness of the resin layer of the roller body is 0.1-2 mm.

3. The method according to claim 1, wherein a position to give the negative pressure to the backside of the belt body is a position where the electrostatic latent image is brought into contact with the developing solution.

4. The method according to claim 1, wherein the developing solution is removed after contacting the electrostatic latent image.

5. The method according to claim 4, wherein a direction of flowing the developing solution when supplying the developing solution to the belt body is reverse to a direction of flowing the developing solution when removing the developing solution.

* * * * *